US005642710A

United States Patent [19]

Hopley et al.

[11] Patent Number: 5,642,710

[45] Date of Patent: Jul. 1, 1997

[54] GOVERNOR MECHANISM

[75] Inventors: Daniel Jeremy Hopley, Gillingham; Adrian Mark Greaney, Rainham, both of England

[73] Assignee: Lucas Industries public limited Company, England

[21] Appl. No.: 664,816

[22] Filed: Jun. 17, 1996

[30] Foreign Application Priority Data

Jul. 1, 1995 [GB] United Kingdom ..... 9513445

[51] Int. Cl.[6] ..... F02D 31/00

[52] U.S. Cl. ..... 123/373; 123/365; 123/450

[58] Field of Search ..... 123/450, 365, 123/373, 372, 370, 371

[56] References Cited

U.S. PATENT DOCUMENTS

| | | | |
|---|---|---|---|
| 2,281,222 | 4/1942 | Baierlein et al. . | |
| 3,699,816 | 10/1972 | Peltret . | |
| 3,885,442 | 5/1975 | Staebler . | |
| 4,098,249 | 7/1978 | Mowbray | 123/450 |
| 4,397,615 | 8/1983 | Mowbray | 123/450 |
| 4,573,444 | 3/1986 | Howes | 123/450 |
| 4,580,538 | 4/1986 | Eheim | 123/365 |
| 4,699,108 | 10/1987 | Rouse | 123/450 |
| 4,785,978 | 11/1988 | Gibson | 123/365 |
| 4,947,814 | 8/1990 | Villanyi | 123/365 |
| 5,255,652 | 10/1993 | Boehm | 123/373 |
| 5,307,725 | 5/1994 | Ruthardt | 123/373 |
| 5,535,721 | 7/1996 | Lewis | 123/365 |

FOREIGN PATENT DOCUMENTS

| | | |
|---|---|---|
| 1 918 411 | 10/1970 | Germany . |
| 2 266 601 | 11/1993 | United Kingdom . |

*Primary Examiner*—Carl S. Miller
*Attorney, Agent, or Firm*—Andrus, Sceales, Starke & Sawall

[57] ABSTRACT

A governor mechanism for use with a fuel pumping apparatus includes a centrifugal weight mechanism which is coupled to an output member the latter being coupled to a fuel control member so that with increasing speed the quantity of fuel supplied by the apparatus is reduced. A governor spring opposes the movement of the output member but in addition a leaf spring is provided to supplement the action of the governor spring. The leaf spring is formed by one end of a torsion spring which is wound about a cylindrical member. The cylindrical member and the torsion spring are axially movable relative to each other to alter the effective number of turns of the torsion spring connected in series with the leaf spring.

6 Claims, 2 Drawing Sheets

GOVERNOR MECHANISM

Figure 1:
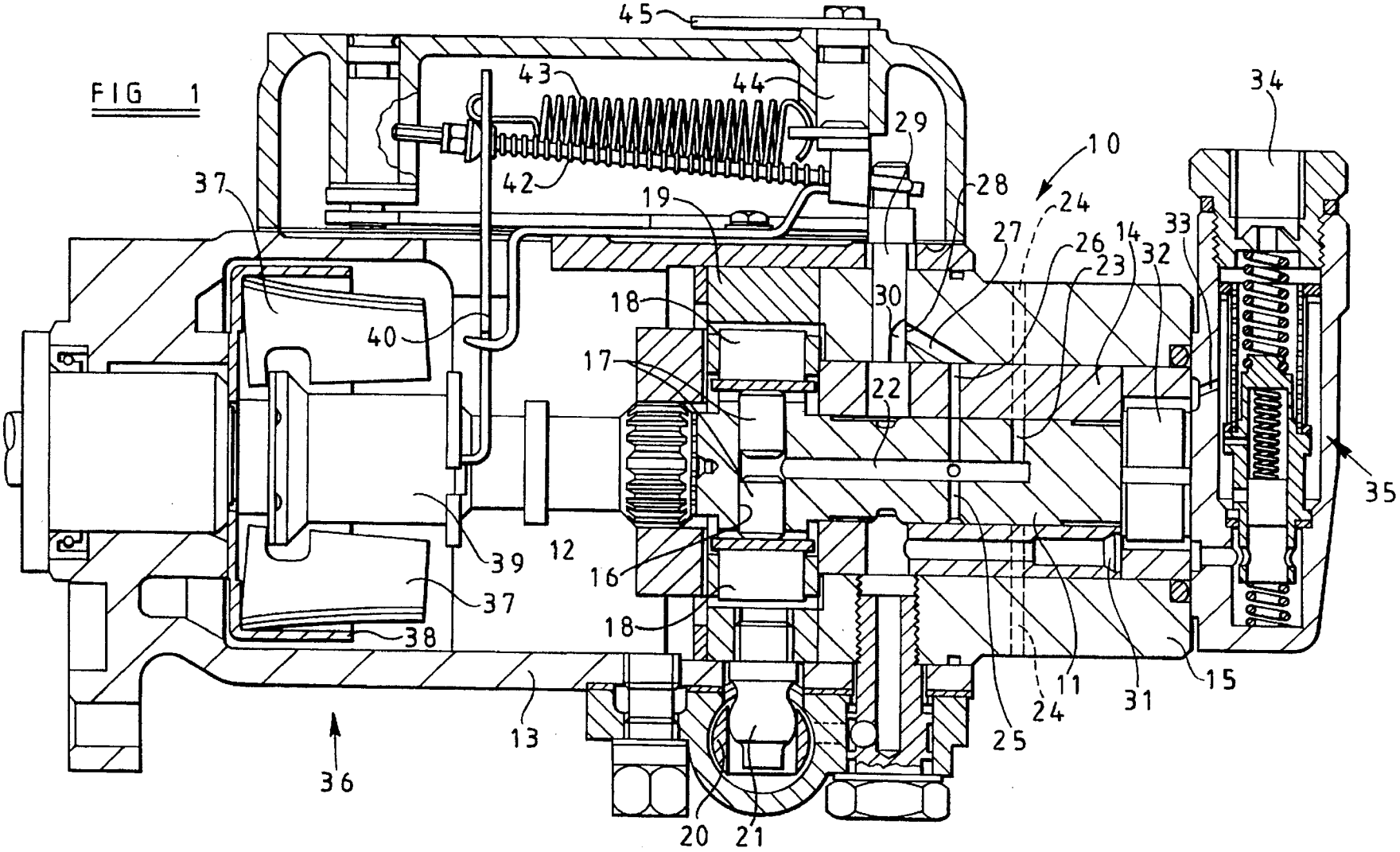

This invention relates to a governor mechanism for use with a fuel pumping apparatus for supplying fuel to an internal combustion engine, the governor mechanism including an output member which is coupled to a fuel control member of the pumping apparatus, a centrifugal weight mechanism which is coupled to the output member and which is driven in timed relationship with the associated engine, the weight mechanism acting with increasing engine speed to reduce the amount of fuel delivered by the pumping apparatus and resilient means operable to oppose the movement of the output member by the weight mechanism.

An example of a governor mechanism of the kind specified is seen in GB-A-2266601 in which the resilient means comprises a coiled tension spring one end of which is coupled to the output member and the other end of which is coupled to an operator adjustable member whereby the force exerted by the spring can be varied in order to provide for adjustment of the governed speed of the associated engine.

The governor mechanism in operation, can vary the amount of fuel which is supplied to the associated engine between a maximum value and a minimum value and the percentage variation of engine speed which has to take place to accomplish this variation is known in the art as the "droop". The "droop" is determined by the net effective rate of the resilient means, the output member and the weight mechanism. Therefore, every effort is made during manufacture to ensure that the spring which forms the resilient means, has the desired spring rate. Variations in spring rate and component geometry do however occur and this means that there will be a difference in the "droop" between individual governor mechanisms. In the case where the associated engine is driving a vehicle small variations in "droop" although undesirable will not matter. However, where the engine is utilised for driving a generator it is important that the "droop" should be closely controlled since the engine speed variation consequent upon a change in load, should be as small as possible. In addition, during use of the associated engine, wear takes place in the components of the governor mechanism and the pumping apparatus and this results in variation of the "droop".

In GB-A-2266601 the resilient means of the governor mechanism includes a leaf spring which acts on the output member to assist the coiled compression spring and the spring rate of the leaf spring can be adjusted from exterior of the housing of the governor mechanism. This has the effect of modifying the combined spring rate and therefore the "droop" of the governor mechanism as a whole. The method shown in GB-A-2266601 of adjusting the spring rate of the leaf spring operates by varying the effective length of the spring.

The object of the present invention is to provide a mechanism of the kind specified in an improved form.

According to the invention in a governor mechanism of the kind specified said resilient means comprises a leaf spring having one end operatively coupled to the output member and its opposite end coupled to a torsion spring and means operable to adjust the effective number of turns and/or a part turn of the torsion spring.

Figure 2:
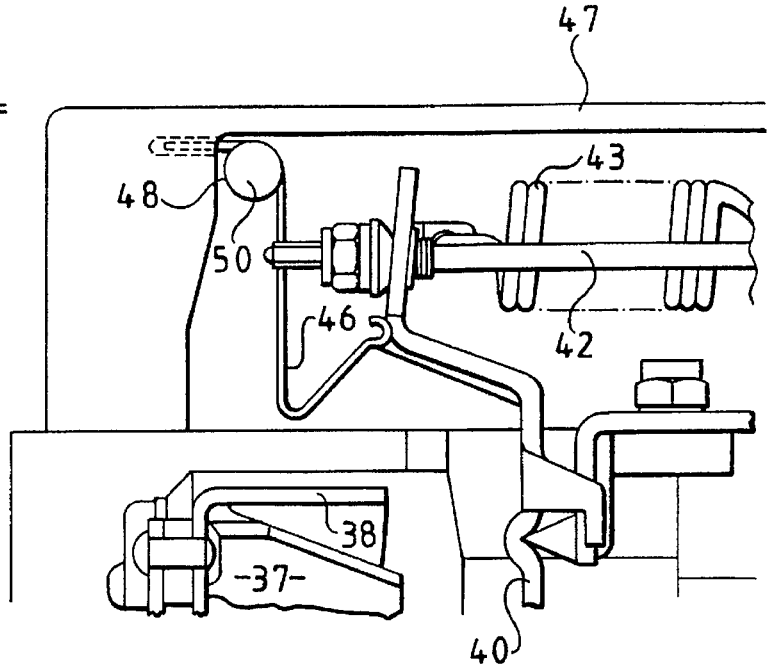
Figure 3:
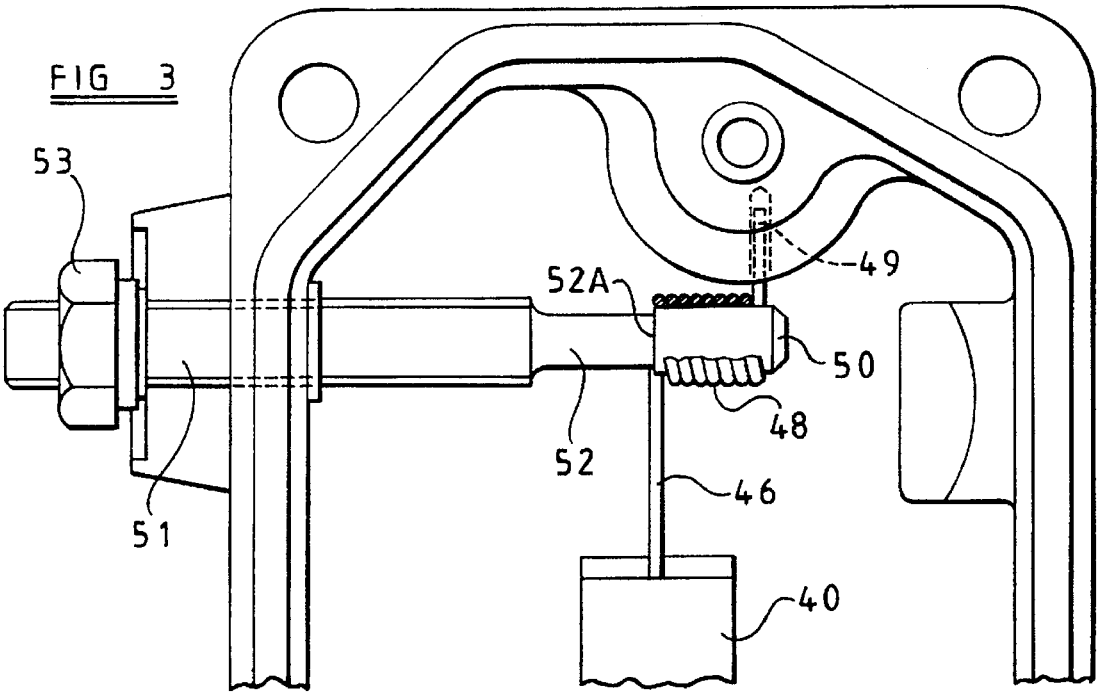

An example of a governor mechanism will now be described with reference to the accompanying drawings in which:

FIG.1 illustrates in sectional side elevation, one example of a governor mechanism shown in conjunction with a fuel pumping apparatus, FIG. 2 shows a side elevation of part of the governor mechanism seen in FIG. 1 modified in accordance with the invention, and FIG. 3 is an underside plan view of part of the mechanism seen in FIG. 2.

Referring to FIG. 1 of the drawings the fuel pumping apparatus 10 is a conventional so called distributor type of apparatus which includes a rotary distributor member 11 which is coupled to a drive shaft 12 supported in a housing 13. The drive shaft 12 in use, is driven in timed relationship with the associated engine. The distributor member is rotatably mounted in a sleeve 14 which is an interference fit in a pump housing 15 and a portion of the distributor member extends from the sleeve, said portion being provided with a transverse bore 16 in which is mounted a pair of pumping plungers 17. At their outer ends the plungers engage cam followers which include rollers 18 which are positioned to engage the internal peripheral surface of an annular cam ring 19, the cam ring having diametrically opposed pairs of cam lobes. The cam ring is angularly adjustable about the axis of rotation of the distributor member in known manner, by means of a fuel pressure actuated piston 20 which is coupled to the cam ring by means of a peg 21.

Formed in the distributor member is an axial passage 22 which communicates with a radially disposed delivery passage 23 and this is positioned to register in turn with a plurality of outlet ports 24 which in use, are connected to the injection nozzles of the associated engine. The communication of the delivery passage with an outlet port occurs during the time when the plungers are moved inwardly by the leading flanks of the cam lobes.

The passage 22 also communicates with a plurality of inlet passages 25 which extend to the periphery of the distributor member to communicate in turn, with an inlet port 26 formed in the sleeve 14. The inlet passage 26 communicates with a further passage 27 in the pump housing 15 and this opens at a port 28, into a bore formed in the housing, and which contains an angularly movable throttle member 29. The throttle member is provided with an axial groove 30 and by moving the throttle member angularly the degree of registration of the groove 30 with the port 28 can be varied.

The groove 30 opens into a chamber formed in the sleeve which is in communication with the outlet 31 of a vane type low pressure pump 32 the rotary part of which is coupled to the distributor member. The pump 32 has an inlet 33 which communicates with a fuel inlet 34 connected in use to a source of fuel and the inlet and outlet of the pump are connected by means of a relief valve 35 which ensures that the outlet pressure of the low pressure pump varies in accordance with the speed at which the apparatus is driven. The piston 20 which determines the angular setting of the cam ring is responsive to this pressure. In operation, during inward movement of the plungers 17 fuel is delivered to one of the outlet ports 24 and hence to the respective injection nozzle of the associated engine. As the distributor member continues to rotate and the rollers 18 pass over the crests of the cam lobes, outward movement of the plungers 17 can take place and fuel is supplied to the bore from the outlet of the low pressure pump by way of the groove 30 and port 28. The amount of fuel which is supplied to the bore containing the plungers depends upon the angular setting of the throttle member 29.

The setting of the throttle member is determined by a governor mechanism generally indicated at 36 and this includes a plurality of centrifugal weights 37 which are mounted in a cage 38 which is secured to the drive shaft 12.

The weights have toe portions which engage through a thrust bearing, a flange formed on an axially movable sleeve 39 which is located about the drive shaft. The sleeve is engaged by one end of a lever 40 which is pivotally mounted intermediate its ends and the opposite end of the lever is coupled to an arm on the throttle member by means of a push rod 42. Moreover, the same end of the lever is secured to one end of a coiled tension spring 43 which forms a governor spring, the opposite end of the tension spring being coupled to an arm which is mounted on an angularly adjustable member 44 which extends to the exterior of the housing and which carries a further arm 45 which is coupled in the case of a vehicle engine, to the throttle pedal of the vehicle. In use, for a given setting of the angularly adjustable member 44, as the speed of the associated engine increases the weights 37 will move outwardly against the action of the spring 43 and in so doing the throttle member will move to reduce the amount of fuel which is supplied to the associated engine. In this manner the engine speed is governed at a value which depends upon the initial load in the spring 43, determined by the position of the member 44. If for a given setting of the member 44 the engine speed decreases, the weights under the action of the force exerted by the spring, will move inwardly to effect movement of the throttle member in the direction to increase the amount of fuel which is supplied to the engine thereby allowing the engine to develop more power.

Turning now to FIG. 2 the parts of which having the same function as those shown in FIG. 1, are assigned the same reference numerals.

As will be seen in FIG. 2, the upper limb of the lever 40 is cranked in a direction over the governor weights and defines a surface for engagement by the curled end of a leaf spring 46. The leaf spring is bent to "V" shape to facilitate its location within a cover 47 forming part of the governor housing. The leaf spring 46 is formed as a continuation of one end of a torsion spring 48, the other end of the torsion spring extending into a drilling 49 formed in the cover.

The torsion spring 48 extends about a cylindrical member 50 which is formed integrally with an adjustment member 51. The adjustment member extends to the exterior of the cover and is in screw threaded engagement therewith. A lock nut 53 is provided to lock the adjustment member in position once adjustment of its axial setting has been effected and to seal the cover. Intermediate the threaded portion of the adjustment member 51 and the cylindrical member 50 is a connecting portion 52 of smaller diameter than the cylindrical member. A radial step 52A is defined at the junction thereof.

The cylindrical member 50 may have a smooth cylindrical surface with the turns of the torsion spring having a light interference fit therewith. It is preferred however to provide a thread form in the surface of the cylindrical member, the pitch of the thread being complementary to that of the turns of the torsion spring. Again there is a light interference fit between the spring and the member. In this case the threaded connection between the adjustment member 51 and the cover has the same pitch as the thread form and the turns of the torsion spring so that the torsion spring retains its axial position as the adjustment member is rotated.

The force exerted by the leaf spring 46 supplements the force exerted by the spring 43. Providing no turns and/or a part turn of the torsion spring 48 overhang the aforesaid step, the torsion spring is inoperative. This is because as shown in FIG. 2, the torsion spring is wound on the cylindrical member so that as the force exerted on the leaf spring is increased the turns of the torsion spring bind more tightly on the surface of the cylindrical member. However, if the adjustment member 51 is rotated so that it moves towards the right as seen in FIG. 3, then although the torsion spring will retain its axial position, part of the torsion spring will overhang the step. Since the connecting portion 52 is of smaller diameter, that portion of the torsion spring which overhangs can act as a spring which will be in series with the leaf spring 46. The effective spring rate of the leaf spring will therefore be reduced. By adjustment of the adjusting member 51 it is therefore possible to adjust the governor "droop" from exterior of the governor housing and it is therefore possible to correct the "droop" following manufacture of the complete mechanism, during the life of the mechanism and for a particular governing application.

The governor mechanism shown in FIG. 1 does not show an idling spring which is usually interposed between the end of the spring 43 and the lever 40. The idling spring is a light spring which operates in conjunction with the weight mechanism to control the idling speed of the engine. In the modified version as shown in FIGS. 2 and 3, the leaf spring 46 can act as the idling spring so that no separate idling spring is required.

The arrangement as described is more compact than the arrangement shown in GB-A-2266601 where the leaf spring has to be substantially straight in view of the form of adjustment which is utilized.

We claim:

1. A governor mechanism for use with a fuel pumping apparatus for supplying fuel to an internal combustion engine, the governor mechanism including an output member which is coupled to a fuel control member of the pumping apparatus, a centrifugal weight mechanism which is coupled to the output member and which is driven in timed relationship with the associated engine, the weight mechanism acting with increasing engine speed to reduce the amount of fuel delivered by the pumping apparatus and resilient means including a leaf spring operable to oppose the movement of the output member by the weight mechanism, wherein said leaf spring has one end operatively coupled to the output member and its opposite end coupled to a torsion spring and means operable to adjust the effective number of turns and/or a part turn of the torsion spring acting in series with the leaf spring.

2. A governor mechanism according to claim 1, wherein said leaf spring is formed as an extension of one end of the torsion spring.

3. A governor mechanism according to claim 2, wherein said torsion spring extends about a cylindrical member, the turns having a light interference fit with the surface of the cylindrical member, the cylindrical member being axially adjustable, said means acting to adjust the axial setting of the cylindrical member relative to the torsion spring to determine the extent of overhang of the torsion spring beyond said surface.

4. A governor mechanism according to claim 3, wherein the cylindrical member is formed as part of an adjustment member which is in screw thread engagement with a cover of the pumping apparatus, the cylindrical member being connected to the threaded portion of the adjustment member by a portion of smaller diameter than the cylindrical member so as to form a step therewith.

5. A governor mechanism according to claim 4, wherein said cylindrical member is provided with a thread form in its surface, the pitch of the thread form being complementary to that of the turns of the torsion spring, the threaded connection between the adjustment member and the cover having the same pitch.

6. A governor mechanism according to claim 1, further comprising a further spring acting on the output member in the direction to oppose movement of the output member by the weight mechanism, and manually operable means for adjusting the force exerted by the further spring.

* * * * *